US007520335B2

(12) United States Patent
Richard et al.

(10) Patent No.: US 7,520,335 B2
(45) Date of Patent: Apr. 21, 2009

(54) CASED HOLE PERFORATING ALTERNATIVE

(75) Inventors: Bennett M. Richard, Kingwood, TX (US); John L. Baugh, Houston, TX (US); Luis E. Mendez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 205 days.

(21) Appl. No.: 11/007,400

(22) Filed: Dec. 8, 2004

(65) Prior Publication Data

US 2005/0121203 A1 Jun. 9, 2005

Related U.S. Application Data

(60) Provisional application No. 60/527,893, filed on Dec. 8, 2003.

(51) Int. Cl.
*E21B 43/10* (2006.01)

(52) U.S. Cl. ..... 166/384; 166/207; 166/227; 166/242.1

(58) Field of Classification Search ..... 166/278, 166/277, 207, 206, 227, 242.1, 384
See application file for complete search history.

(56) References Cited

U.S. PATENT DOCUMENTS

| | | | | |
|---|---|---|---|---|
| 2,419,313 | A | 4/1947 | Byrd | |
| 3,099,318 | A | 7/1963 | Miller et al. | |
| 3,880,233 | A | 4/1975 | Muecke et al. | |
| 5,355,956 | A | 10/1994 | Restarick | |
| 5,366,012 | A | 11/1994 | Lohbeck | |
| 5,425,424 | A | 6/1995 | Reinhardt et al. | |
| 5,443,121 | A | 8/1995 | Saucier | |
| 5,617,919 | A | 4/1997 | Saucier | |
| 5,667,011 | A * | 9/1997 | Gill et al. | 166/295 |
| 5,901,789 | A | 5/1999 | Donnelly et al. | |
| 6,263,966 | B1 | 7/2001 | Haut et al. | |
| 6,315,040 | B1 | 11/2001 | Donnelly | |
| 6,354,373 | B1 | 3/2002 | Vercaemer et al. | |
| 6,457,533 | B1 | 10/2002 | Metcalfe | |
| 6,460,759 | B1 | 10/2002 | Lowry et al. | |
| 6,523,611 | B1 | 2/2003 | Bakker et al. | |
| 6,543,545 | B1 | 4/2003 | Chatterji et al. | |
| 6,571,871 | B2 | 6/2003 | Lauritzen et al. | |
| 6,607,032 | B2 | 8/2003 | Voll et al. | |
| 6,719,064 | B2 * | 4/2004 | Price-Smith et al. | 166/387 |
| 2002/0020524 | A1 | 2/2002 | Gano | |

(Continued)

FOREIGN PATENT DOCUMENTS

| | | |
|---|---|---|
| WO | WO 00/39432 | 7/2000 |

(Continued)

*Primary Examiner*—David J Bagnell
*Assistant Examiner*—Robert E Fuller
(74) *Attorney, Agent, or Firm*—Steve Rosenblatt

(57) ABSTRACT

Casing is scored but not penetrated in one embodiment of a method that allows access to the formation without perforating or section milling the casing. In the run in condition the casing is impervious, to allow cement to be pumped through it to seal the annular space between the casing and the wellbore. After the cement is delivered and displaced through a shoe, the casing is expanded in the regions where it was scored to create openings that go against the wellbore wall. In between the expanded sections the cemented casing offers isolation between adjacent formations.

12 Claims, 8 Drawing Sheets

U.S. PATENT DOCUMENTS

| | | | | |
|---|---|---|---|---|
| 2003/0221840 | A1 | 12/2003 | Whitelaw et al. | |
| 2004/0040723 | A1 * | 3/2004 | Hovem | 166/384 |
| 2004/0251033 | A1 * | 12/2004 | Cameron et al. | 166/382 |
| 2006/0037745 | A1 * | 2/2006 | Hart et al. | 166/242.1 |

FOREIGN PATENT DOCUMENTS

| | | | |
|---|---|---|---|
| WO | WO 02/075108 | A1 | 9/2002 |
| WO | WO 02/092962 | A1 | 11/2002 |
| WO | WO 2004/020787 | | 3/2004 |

* cited by examiner

CASED HOLE PERFORATING ALTERNATIVE

PRIORITY INFORMATION

This application claims the benefit of U.S. Provisional Application No. 60/527,893 filed on Dec. 8, 2003.

FIELD OF THE INVENTION

The field of the invention is a completion technique for cased and cemented wellbores where access to the producing formations can be attained without perforating or section milling the casing and cement.

BACKGROUND OF THE INVENTION

Traditional completion methods in cased holes call for running in casing with a cementing shoe at the lower end. After a section of casing is properly located and supported, cement is pumped through it and out the cementing shoe and into an annular space between the casing and the borehole wall. The residual cement is pushed toward the shoe with a dart or a plug to clear the casing interior of excess cement. After the cement sets a perforating gun is placed at the proper depth and fired through the casing and cement for access to the formation behind for production of the well. Alternatively, a section of the casing and the cement behind it can be cut and milled away to provide comparable access to the formation. As an alternative to cementing the casing, the annular space around the casing can be sealed with external casing packers. However, even when using this technique, access to the formation is still required such as by using these aforementioned techniques.

Perforating is a costly operation and has, associated with it the additional hazard of handling explosives. The setting off of perforating guns generates a fair amount of debris in the casing that must be removed. There are also potential adverse effects on the formation from the act of perforation. Traditional cement completions also have potential problems with cement bonding and may require the use of external casing packers for zone isolation between or among various zones in the wellbore.

More recently, expansion of tubulars downhole has become more prevalent. In the past, when expanding a tubular to act as a perforated liner, it has been known to put rectangular slots in the tubular before expanding it. The presence of these open slots weakens the tubular to reduce the effort required to expand it. The open rectangular slots turn into diamond shapes after expansion. An example of this process is U.S. Pat. No. 5,366,012.

Other applications have involved taking screen or slotted liner with rectangular slots and adding covers so that killing the well is not necessary for running in the casing because the casing, in the run in condition will withstand pressure differentials of 50 bar with the blow out preventer closed. After the liner is in position, it is expanded and can function as a slotted liner particularly in unconsolidated formations. This technique is illustrated in U.S. Pat. No. 6,523,611.

In other applications, casing has been outfitted with sliding sleeve valves that selectively cover a plurality of telescoping outlets covered by a rupture disc. When pressure is built up after the sliding sleeve valve is opened, the outlet telescopes through the cement and fractures the formation. Production is then obtained through the telescoping outlets. An example of such a system is U.S. Pat. No. 5,425,424. This system is expensive and has a variety of operational issues of actually breaking all the rupture discs and actually penetrating the formation with the telescoping outlets depending on the wellbore shape.

What is needed and not provided with the prior designs is a system that can eliminate the costly and more risky techniques of perforating or section milling and allow good zone isolation while providing reliable access to the producing formation. These and other advantages of the present invention will become more apparent to those skilled in the art from a review of the description of the preferred embodiment, the drawings and the claims, which appear below.

SUMMARY OF THE INVENTION

Casing is scored but not penetrated in one embodiment of a method that allows access to the formation without perforating or section milling the casing. In the run in condition the casing is impervious, to allow cement to be pumped through it to seal the annular space between the casing and the wellbore. After the cement is delivered and displaced through a shoe, the casing is expanded in the regions where it was scored to create openings that go against the wellbore wall. In between the expanded sections the cemented casing offers isolation between adjacent formations.

DETAILED DESCRIPTION OF THE PREFERRED EMBODIMENT

Figure 1:
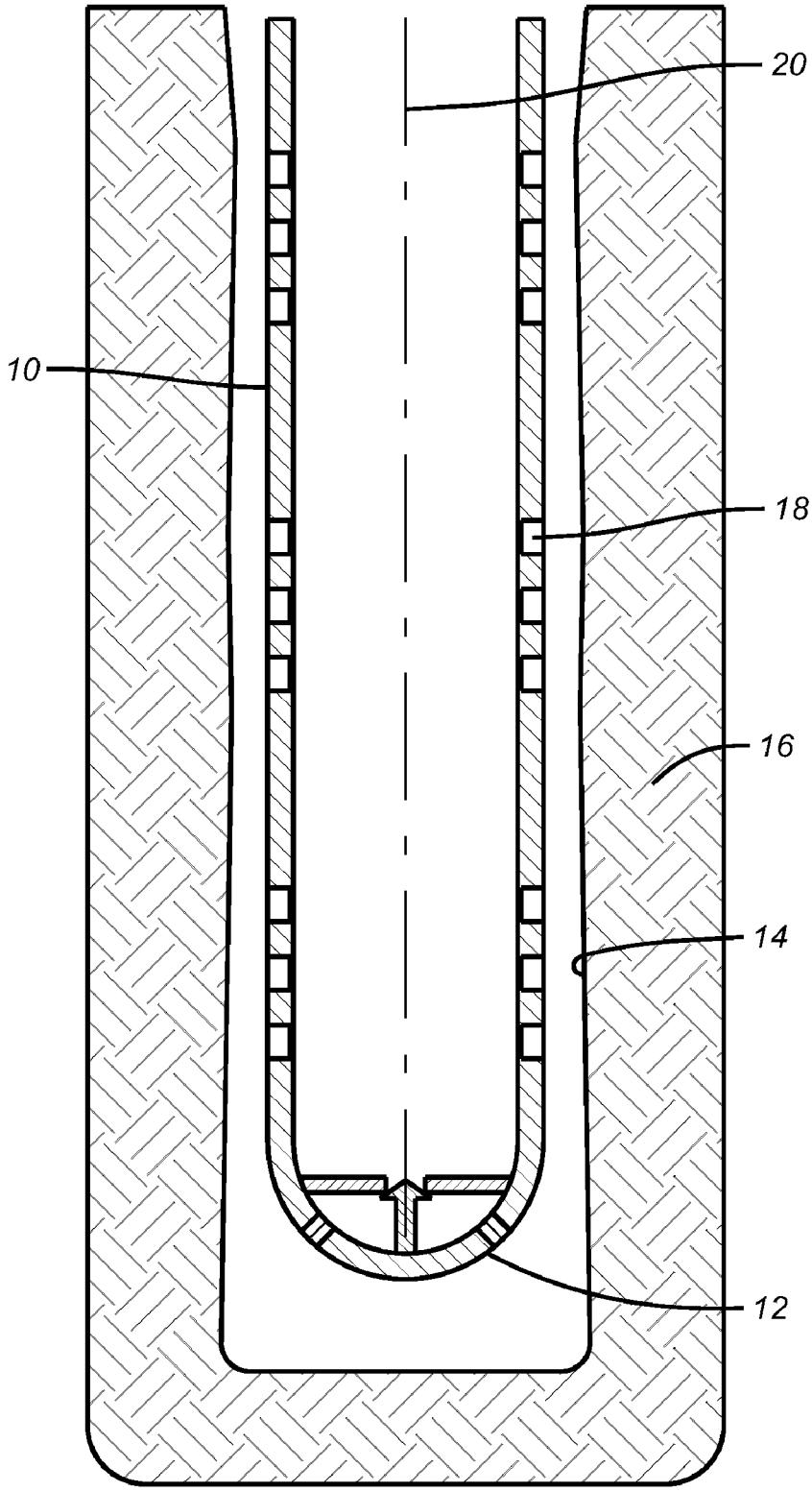
FIG. 1 shows the run in position in section, illustrating different intervals that are scored.

FIG. 1 shows the run in position with the casing 10 having a cement shoe 12 at its lower end inserted into the wellbore 14 adjacent at least one formation of interest 16. In the preferred embodiment a series of scores 18 are preferably disposed in alignment with the longitudinal axis 20 in a series of rows extending circumferentially where scores in one row are offset from those in an adjacent row. The lengths of the scores 18 can be overlapping in the longitudinal direction.

Figure 2:
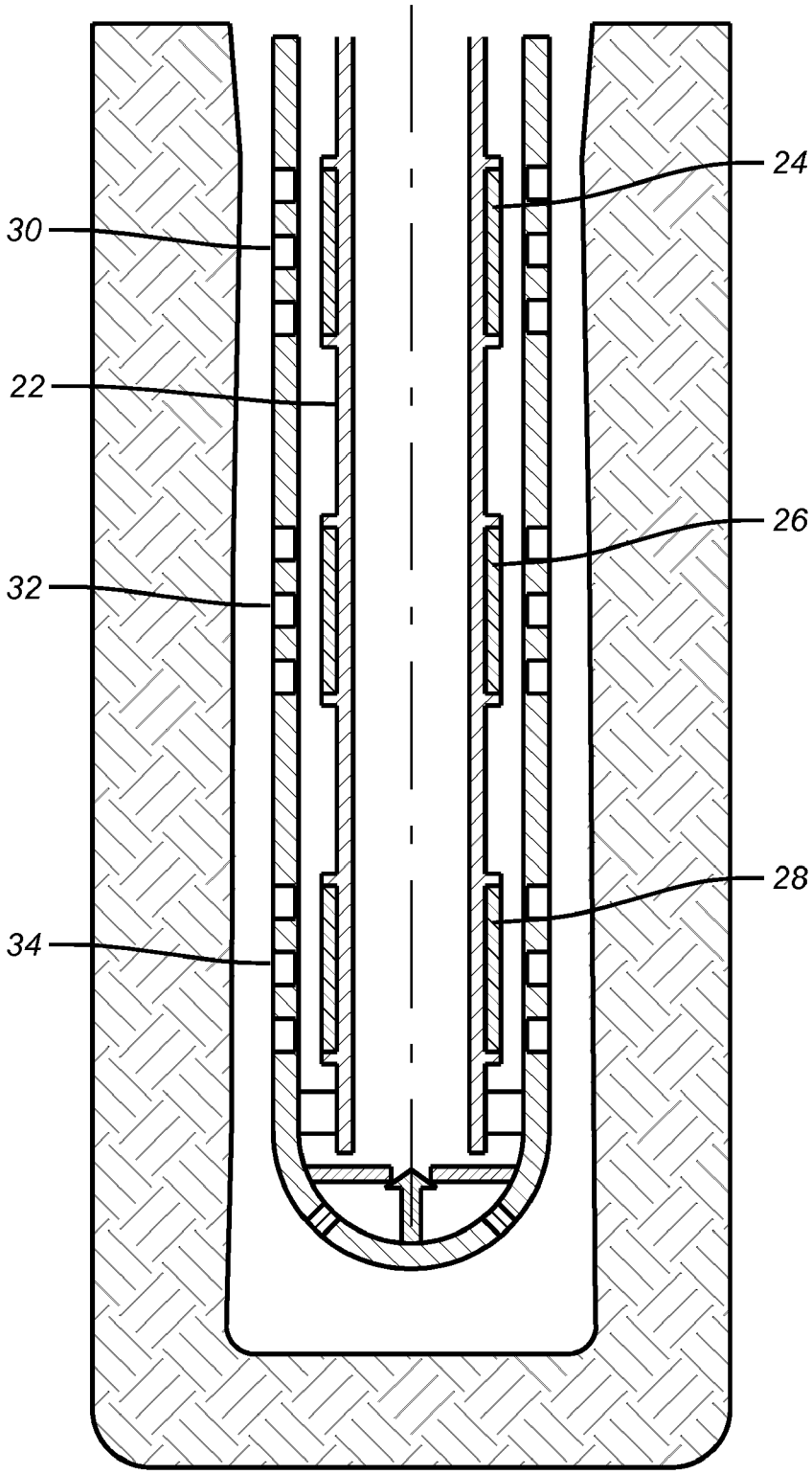
FIG. 2 shows the cementing string with packers that can expand in alignment with the scored sections, just prior to pumping cement.

To complete the process, FIG. 2 illustrates the insertion of a cementing string 22 that has on it external packers 24, 26 and 28 that align with scored segments 30, 32 and 34.

Figure 3:
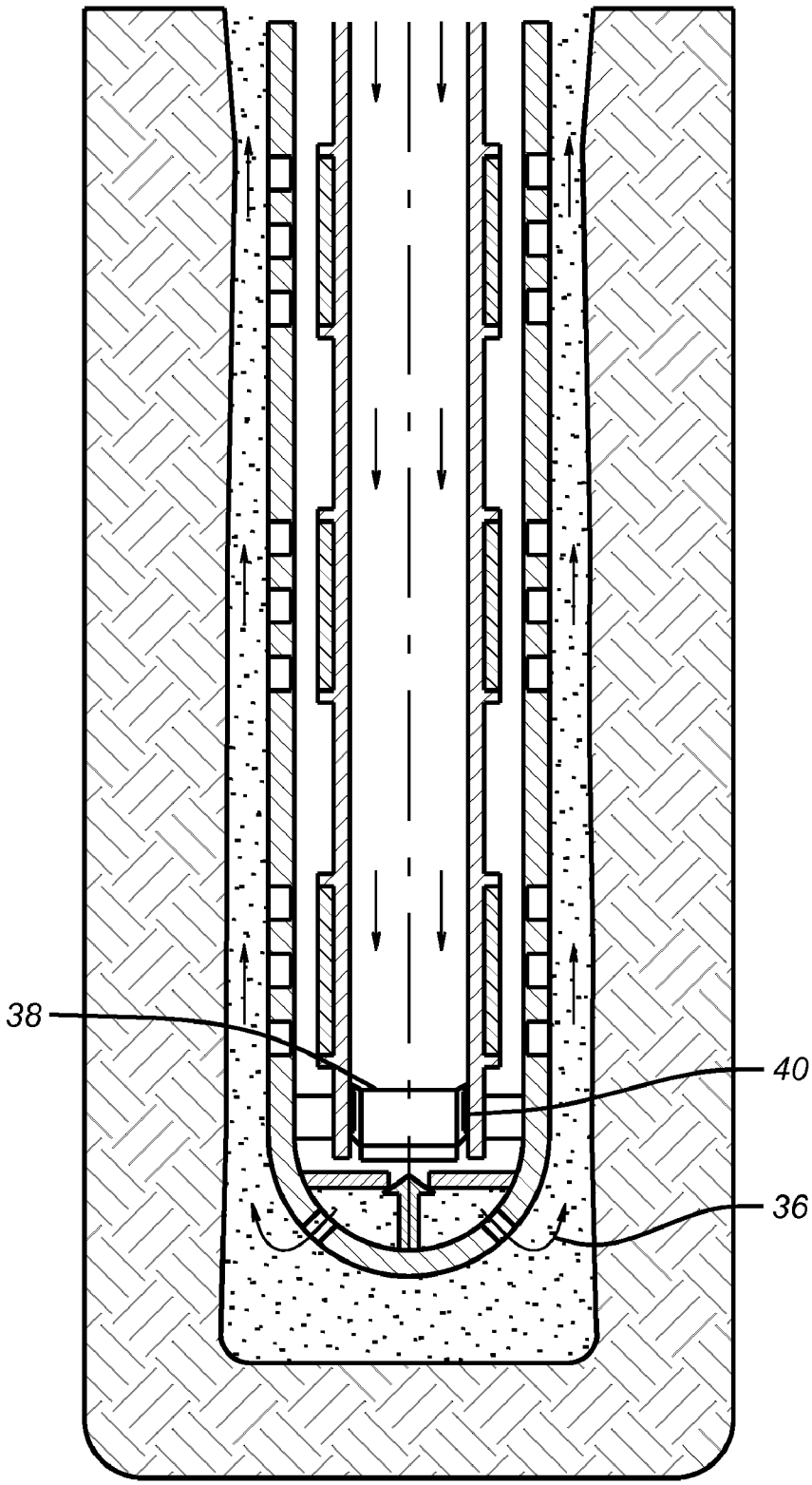
FIG. 3 shows cement having been pumped and displaced from the casing with a pressure plug.

FIG. 3 illustrates the pumping of cement or other sealing material 36 followed by the delivery of a pressure plug or wiper 38 until it lands on a profile 40 in the cementing string 22.

Figure 4:
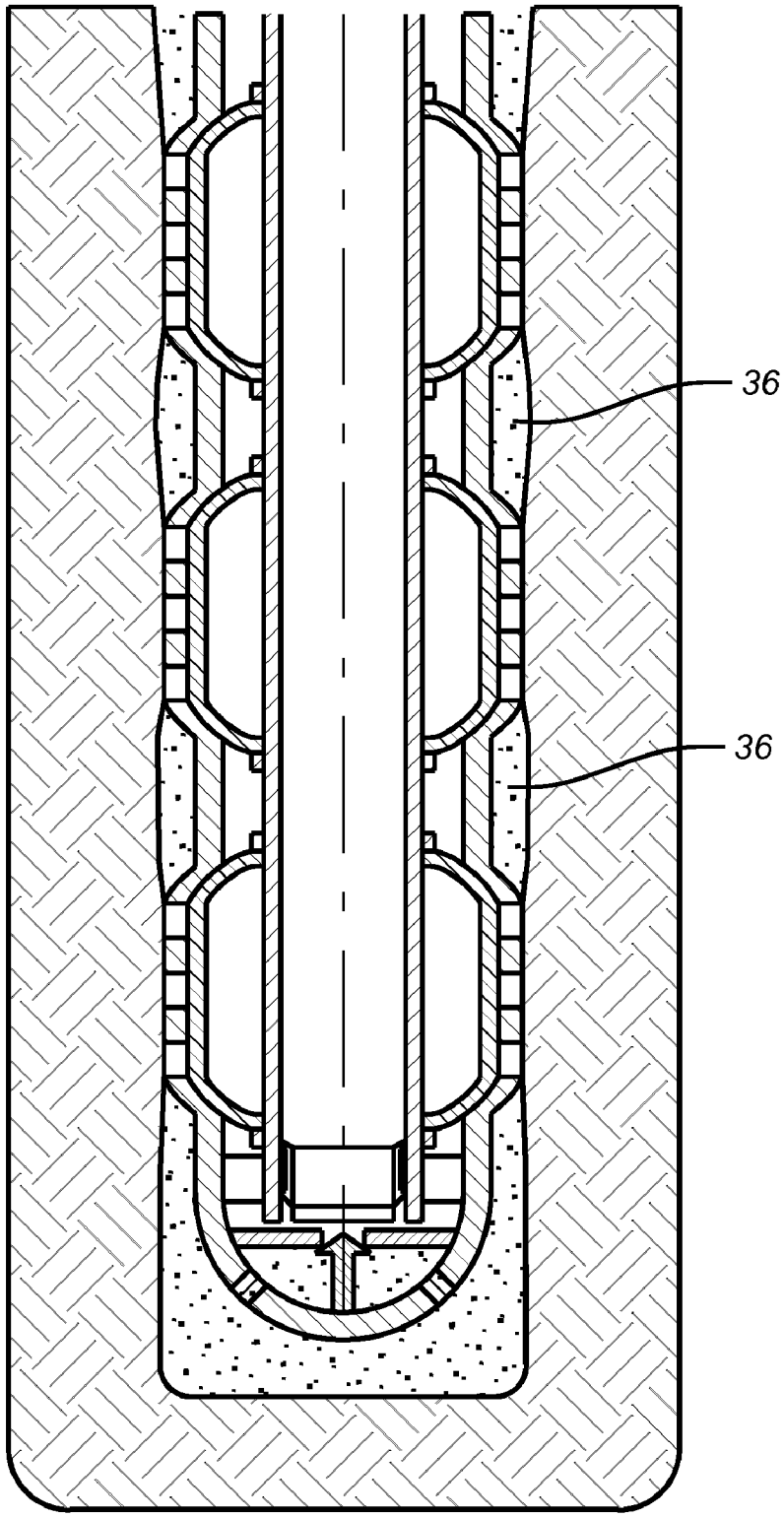
FIG. 4 shows the packers expanding the scored sections to create openings positioned against the wellbore wall.
Figure 5:
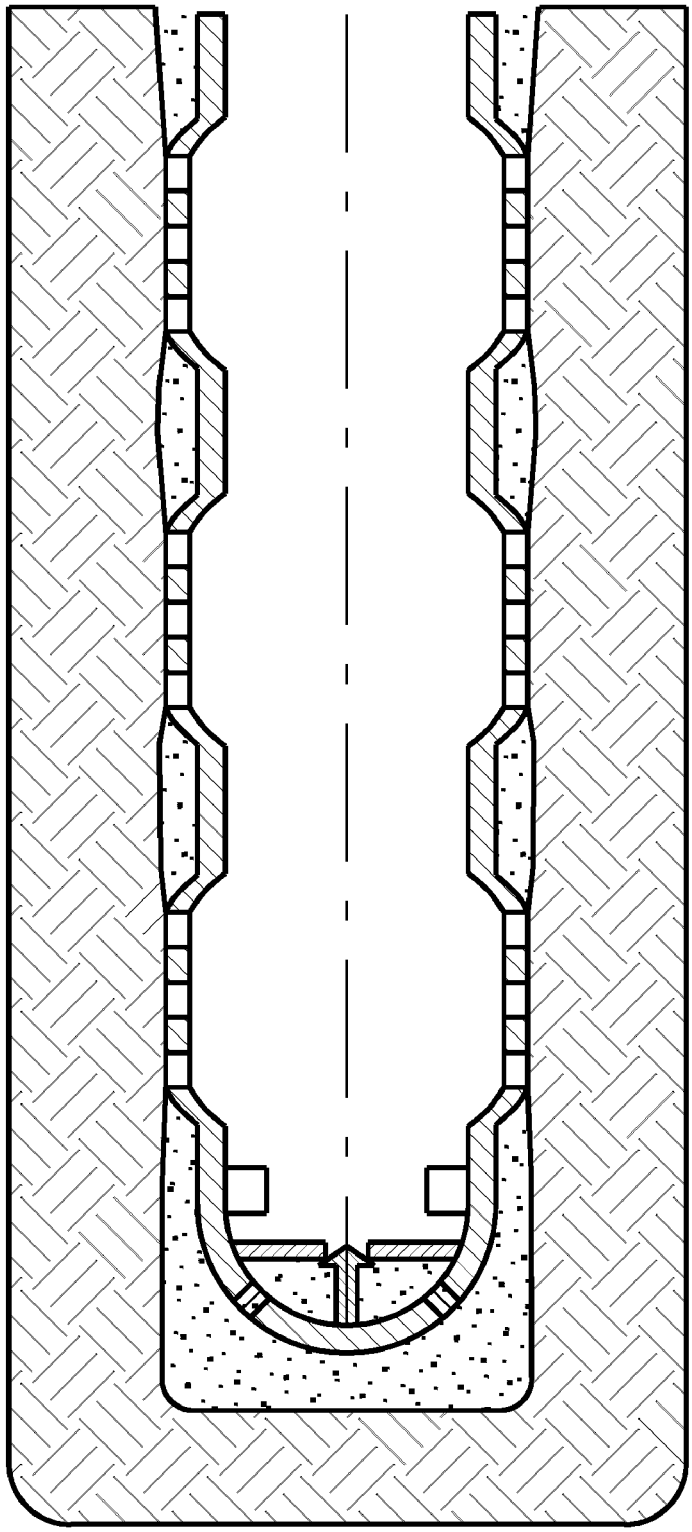
FIG. 5 is the view of FIG. 4 with the cementing string removed.

FIG. 4 illustrates actuation of the external packers 24, 26 and 28 so as to press the scored segments 30, 32 and 34 against the formation 16 at the wellbore wall 14. The cement 36 becomes trapped by the expansion of the scored segments 30, 32 and 34. FIG. 5 simply shows the same view as FIG. 4 except the cementing string 22 has been removed.

Figure 6:
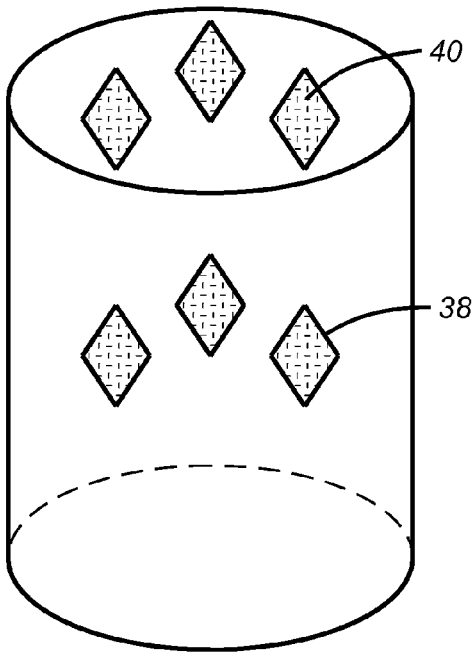
FIG. 6 is an alternate embodiment showing covers in openings before expansion.
Figure 7:
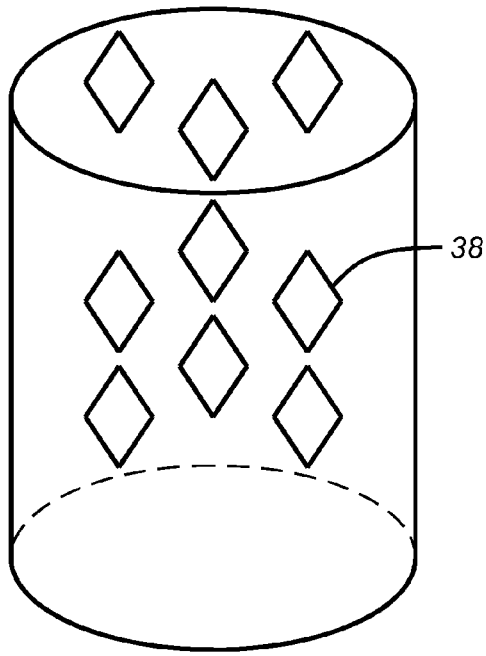
FIG. 7 shows the covers removed as a result of expansion.

The method incorporates the ability to run casing and cement it and thereafter provide access to the producing formation without perforation or section milling techniques. This can be accomplished in a variety of ways apart from the preferred embodiment described above. The scores 18 can be part way, most of the way or if sufficiently narrow so as to not allow excessive flow during cementing can be all the way. Alternatively, openings 38 in the casing 10 can be through the wall in a variety of shapes or arrangements but held otherwise closed during the cementing operation. As shown in FIGS. 6 and 7, the covers or plugs 40 for individual or groups of openings can be secured in a manner that upon shape change of the opening that occurs during expansion the covers can come out leaving the accessible openings that are pushed into the wellbore wall 14. Those skilled in the art will realize that the external packers are but one way to achieve the desired expansion in selected areas. Alternatively, an adjustable swage can be used to selectively mechanically expand the scored segments, as required. The swage can also be hydraulically powered as opposed to being operated with a surface force applied to the cementing string after the cement has been properly displaced.

The scores 18 can be linear or have other configurations. The scores 18 should selectively weaken the casing 10 to ease the required expansion force. The scores 18 when made straight will generally create diamond shaped openings that are forced into the wellbore wall 14. Subsequently, a production string with screens can be inserted and gravel packed in the known manner. Alternatively, the screen sections can also be expanded against the casing 10, as an alternative to gravel packing.

Figure 8:
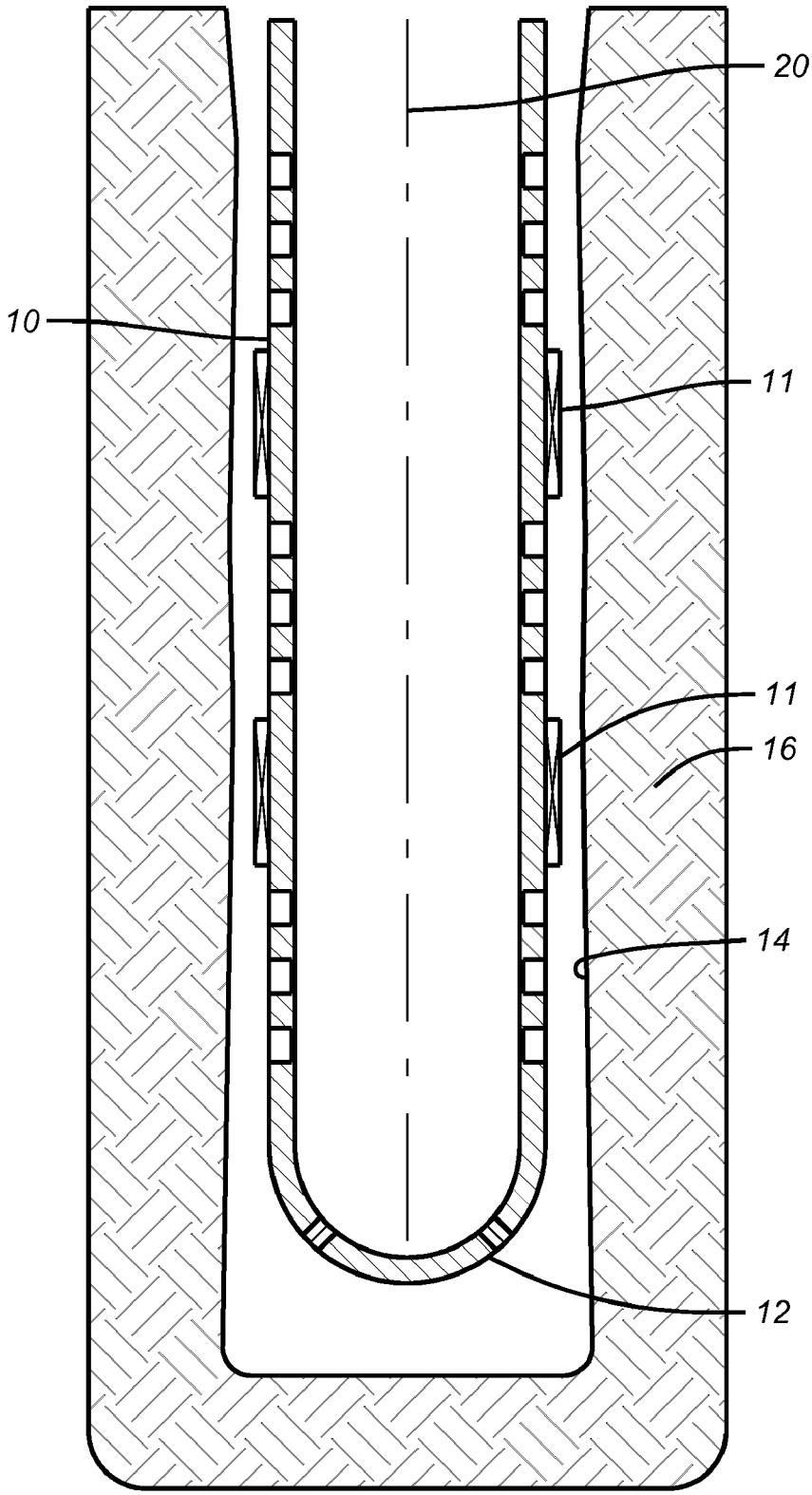
FIG. 8 is an alternative to the FIGS. 1-3 embodiment showing external packers used instead of cementing with the packers in the run in position.
Figure 9:
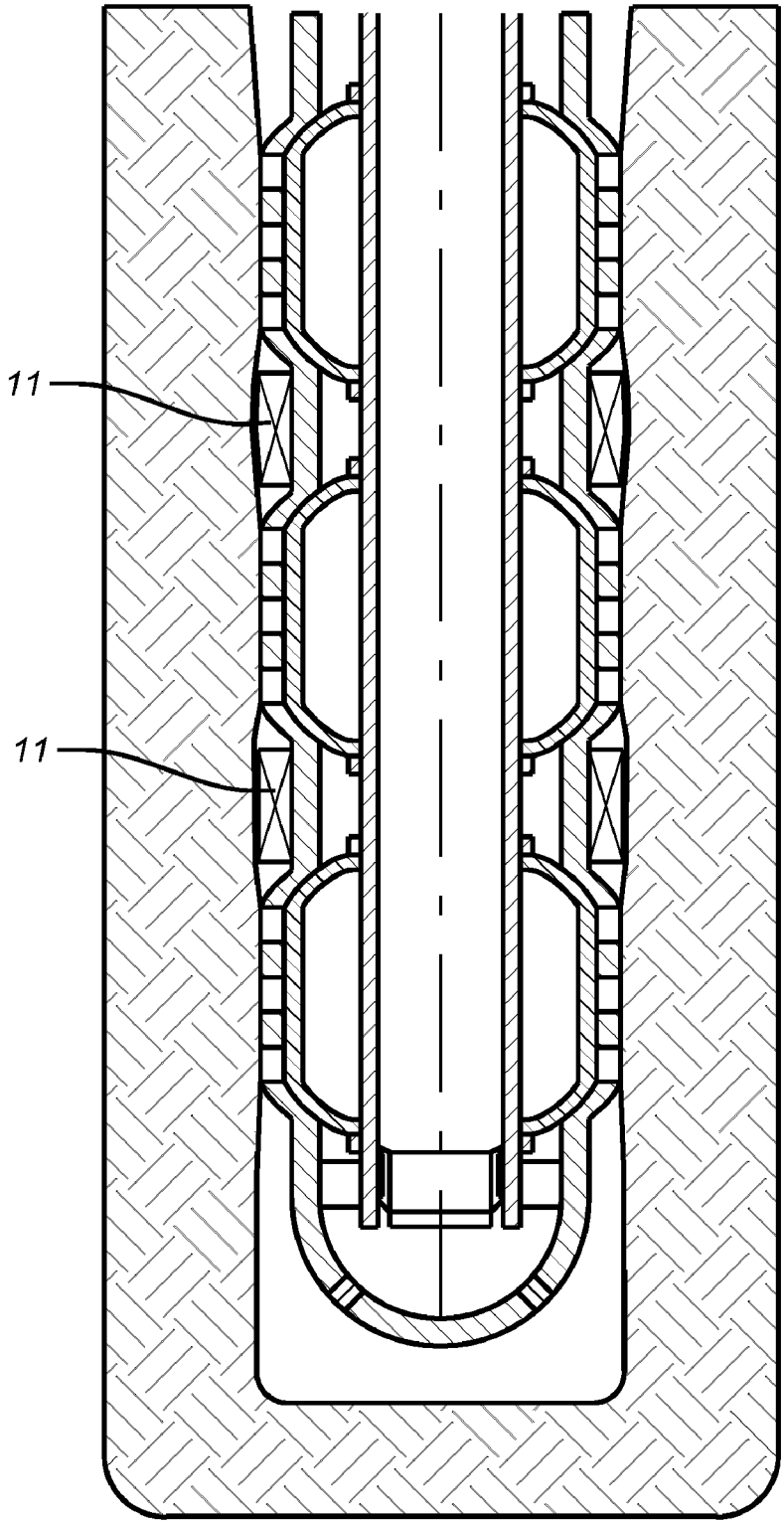
FIG. 9 is the view of FIG. 8 with the external packers set.

Ideally, the expansion of the scored segments 30, 32 and 34 should take place when the cement is still wet and has not set up. If expanding with the packers 24, 26 and 28, they can be left in position until the cement sets or they can be removed after the expansion is complete. Cement does not have to be used to seal the casing 10 in the wellbore 14. External casing packers 11 can be used instead. The packers 11 are shown in the run in position in FIG. 8 and in the set position adjacent scored sections in FIG. 9. Alternatively, the casing can be coated or can otherwise possess a layer of polymer that can swell and seal the annular space between the casing 10 and the wellbore 14. The location of the scored segments in the casing can be determined by known logging techniques.

The method of the present invention saves the costs associated with perforating or section milling. There is no debris to remove from the wellbore. Zone isolation is improved as the cement is trapped between a pair of expanded segments. Additionally, better access to the producing zones is obtained with less adverse impact on the producing formation than was the case with prior techniques for obtaining access after cementing. Cement bonding to the casing can also be enhanced while wellbore stability is improved. More options are available for different completions with the method of the present invention.

The foregoing disclosure and description of the invention are illustrative and explanatory thereof, and various changes in the size, shape and materials, as well as in the details of the illustrated construction, may be made without departing from the spirit of the invention.

We claim:

1. A method of providing formation access through a tubular, comprising:

providing a tubular having at least one portion scored at least partially through its wall and at least one adjacent unscored portion;

running said tubular into a wellbore;

delivering a sealing material through an expansion device to an annular space around said tubular after said running in;

expanding with said expansion device, after said delivering, said at least one scored portion of said tubular to make wellbore contact;

using said sealing material in said annular space around said unscored portion for sealing;

creating access openings to the formation from said scoring in said at least one portion due to said expanding.

2. The method of claim 1, comprising:

leaving said scoring exposed on the outer face of the tubular for said running said tubular into a wellbore.

3. The method of claim 1, comprising:

sealing between the tubular and the wellbore outside of said at least one portion as a result of said expanding.

4. The method of claim 3, comprising:

using a material that swells downhole for said sealing.

5. The method of claim 3, comprising:

providing more than one discrete portion on said tubular with scoring.

6. The method of claim 5, comprising:

expanding only said portions against the wellbore wall.

7. The method of claim 6, comprising:

using at least one packer to expand each portion.

8. The method of claim 6, comprising:

using at least one swage to expand each portion.

9. The method of claim 1, comprising:

providing said scoring only part way through the wall of the tubular.

10. A method of providing formation access through a tubular, comprising:

providing a tubular having at least one portion scored at least partially through its wall and at least one adjacent unscored portion;

running said tubular into a wellbore;

delivering a sealing material through an expansion device to a surrounding annular space in the wellbore;

expanding with said expansion device said at least one scored portion of said tubular to make wellbore contact;

displacing sealing material away from said scored portion to said unscored portion by said expanding;

creating access openings to the formation from said scoring in said at least one scored portion due to said expanding;

leaving sealing material between the tubular and the wellbore outside of said at least one scored portion.

11. A method of providing formation access through a tubular, comprising:

providing a tubular having a plurality of discrete portions scored at least partially through its wall;

running said tubular into a wellbore;

delivering a sealing material through said tubular to a surrounding annular space in the wellbore;

expanding only said portions against the wellbore wall;

using at least one packer to expand each portion;

expanding and leaving said packer in place after said delivering until said sealing material sets;

creating access openings to the formation from said scoring in said at least one portion due to said expanding;

sealing between the tubular and the wellbore outside of said at least one portion as a result of said expanding.

12. A method of providing formation access through a tubular, comprising:

providing a tubular having a plurality of discrete portions scored at least partially through its wall;

running said tubular into a wellbore;

expanding only said discrete portions of said tubular to make wellbore contact; and creating access openings to the formation from said scoring in said discrete portions due to said expanding;

sealing between the tubular and the wellbore at an axially displaced location to discrete portions;

displacing a sealing material located outside said discrete portions of said tubular by expansion of said discrete portions.

* * * * *